US007855499B2

(12) United States Patent
Park

(10) Patent No.: US 7,855,499 B2
(45) Date of Patent: Dec. 21, 2010

(54) BACK LIGHT UNIT USING AN ELECTRON EMISSION DEVICE AND DISPLAY INCLUDING THE SAME

(75) Inventor: Jin-woo Park, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 406 days.

(21) Appl. No.: 12/000,994

(22) Filed: Dec. 19, 2007

(65) Prior Publication Data

US 2008/0150413 A1 Jun. 26, 2008

(30) Foreign Application Priority Data

Dec. 20, 2006 (KR) ..... 10-2006-0131035

(51) Int. Cl.
*H01J 1/62* (2006.01)
*H01J 63/04* (2006.01)

(52) U.S. Cl. ..... 313/496; 313/495; 313/113; 345/75

(58) Field of Classification Search ..... None
See application file for complete search history.

(56) References Cited

U.S. PATENT DOCUMENTS 7,291,969 B2 * 11/2007 Tsutsui ..... 313/504
7,432,646 B2 * 10/2008 Choi et al. ..... 313/497
7,489,069 B2 * 2/2009 Chen ..... 313/309
2005/0264168 A1 12/2005 Lee
2006/0076881 A1 4/2006 Kim et al.

FOREIGN PATENT DOCUMENTS

| | | |
|---|---|---|
| JP | 2002-304961 | 10/2002 |
| JP | 2004-152715 | 5/2004 |
| JP | 2005-340189 | 12/2005 |
| KR | 10-2002-0033948 A | 5/2002 |
| KR | 10-2002-0036888 A | 5/2002 |
| KR | 10-2005-0113900 A | 12/2005 |
| KR | 10-2006-0031479 A | 4/2006 |

* cited by examiner

*Primary Examiner*—Ashok Patel
(74) *Attorney, Agent, or Firm*—Lee & Morse, P.C.

(57) ABSTRACT

A back light unit may include an electron emitter substrate adapted to emit electrons from a front surface and a rear surface thereof, a first anode substrate arranged opposite to the front surface of the electron emitter substrate, the first anode substrate adapted to receive electrons emitted from the electron emitter substrate, to emit light in response to the electrons, and to output the light from a front surface of the first anode substrate, and a second anode substrate arranged opposite to the rear surface of the electron emitter substrate, the second anode substrate adapted to receive electrons emitted from the electron emitter substrate, to emit light in response to the electrons, and to reflect light to the first anode substrate.

20 Claims, 2 Drawing Sheets

BACK LIGHT UNIT USING AN ELECTRON EMISSION DEVICE AND DISPLAY INCLUDING THE SAME

BACKGROUND OF THE INVENTION

1. Field of the Invention

Embodiments relate to a back light unit using an electron emission device and a display including the same. More particularly, embodiments relate to a back light unit using an electron emission device capable of enhancing luminous efficiency and a display including the same.

2. Description of the Related Art

Flat panel displays may include a display region in which a plurality of pixels is arranged on a substrate in a matrix format. Flat panel displays may display an image on the display region by connecting scan lines and data lines to each of the plurality of pixels, followed by selectively applying a data signal to the pixels.

Flat panel displays include a passive matrix-type display device and an active matrix-type display device, the types corresponding to the method used to drive the pixels. Active matrix-type display devices, in which every unit pixel is selected and turned on, are often used, as they provide good resolution, contrast, and response time.

Flat panel displays have been used as displays or monitors for information appliances, e.g., personal computers, mobile phones, personal digital assistants, etc. Flat panel displays include a liquid crystal display (LCD) using a liquid crystal panel, an organic light emitting diode display device using an organic light emitting diode (OLED), a plasma display using a plasma display panel (PDP), an electron emission device display using an electron emission device, and the like. Flat panel displays may be categorized as emissive or non-emissive, depending on whether the display produces images by generating light itself or just controlling transmission and spectral characteristics of externally supplied light, respectively.

Non-emissive displays, e.g., LCDs, use a back light unit for providing light to a panel of non-emissive elements, e.g., LCs. The back light unit may include electron emission devices. Electrons are emitted from an emitter of an electron emitter substrate towards an anode electrode, and a photoluminescent material on the anode electrode emits light in response to the electrons.

If such a back light unit is used, luminance of the display may be enhanced by increasing an amount of the emitted electrons by increasing a driving voltage. However, when the driving voltage is increased, power consumption is also increased.

SUMMARY OF THE INVENTION

Embodiments are therefore directed to a back light unit and a display including the back light unit, which overcome one or more of the above disadvantages of the related art.

It is therefore a feature of an embodiment to provide a back light unit using an electron emission device having an enhanced luminance, and a display including the same.

It is therefore a feature of an embodiment to provide a back light unit using an electron emission device have reduced power consumption, and a display including the same.

At least one of the above and other features and advantages may be realized by providing a back light unit, including an electron emitter substrate adapted to emit electrons from a front surface and a rear surface thereof, a first anode substrate arranged opposite to the front surface of the electron emitter substrate, the first anode substrate adapted to receive electrons emitted from the electron emitter substrate, to emit light in response to the electrons, and to output the light from a front surface of the first anode substrate, and a second anode substrate arranged opposite to the rear surface of the electron emitter substrate, the second anode substrate adapted to receive electrons emitted from the electron emitter substrate, to emit light in response to the electrons, and to reflect light to the first anode substrate.

The electron emitter substrate may include a transparent substrate, a plurality of first cathode electrodes on a front surface of the transparent substrate, a plurality of second cathode electrodes on a rear surface of the transparent substrate, a plurality of first insulators crossing the plurality of first cathode electrodes, a plurality of second insulators crossing the plurality of second cathode electrodes, a plurality of first gate electrodes on the plurality of first insulators, a plurality of second gate electrodes on the plurality of second insulators, a plurality of first emitters on the plurality of first cathode electrodes and between adjacent first gate electrodes, and a plurality of second emitters on the plurality of second cathode electrodes and between adjacent second gate electrodes.

At least one or more or all of the plurality of first cathode electrodes, first insulators, first gate electrodes, second cathode electrodes, second insulators, and second gate electrodes may be transparent.

Corresponding first and second cathode electrodes may receive a same cathode signal, and corresponding first and second gate electrodes may receive a same gate signal.

The electron emitter substrate may include a transparent substrate and a plurality of emitters on both surfaces of the transparent substrate. The electron emitter substrate may further include transparent operational elements adapted to cause the plurality of emitters to emit electrons.

The first anode substrate may include a transparent substrate, a photoluminescent material on a rear surface of the transparent substrate, and an anode electrode on the photoluminescent material. The first anode substrate may further include a black matrix on the rear surface of the transparent substrate, the photoluminescent material being between adjacent portions of the black matrix, and an interlayer on the black matrix and the photoluminescent material, below the anode electrode.

The second anode substrate may include a substrate, a reflective layer on a front surface of the substrate, a photoluminescent material on the reflective layer, and an anode electrode on the photoluminescent material. The second anode substrate may further include a black matrix on the reflective layer, the photoluminescent material being between adjacent portions of the black matrix, and an interlayer on the black matrix and the photoluminescent material, below the anode electrode.

The first anode substrate may include a first photoluminescent material, the second anode substrate may include a second photoluminescent material, and the first and second photoluminescent materials may be the same.

At least one of the above and other features and advantages may be realized by providing a display, including a pixel unit adapted to receive a data signal, a scan signal, and light by block unit, and to display an image, the block unit including a plurality of blocks, a data driver adapted to receive an image signal, generate the data signal and transmit the data signal to the pixel unit, a scan driver adapted to generate the scan signal and transmit the scan signal to the pixel unit, and a back light unit including a plurality of light sources corresponding to the plurality of the blocks, the back light unit adapted to transmit light to the pixel unit. The back light unit may include an electron emitter substrate adapted to emit electrons from a front surface and a rear surface thereof, a first anode substrate arranged opposite to the front surface of the electron emitter substrate, the first anode substrate adapted to receive electrons emitted from the electron emitter substrate, to emit light in response to the electrons, and to output the light from a front surface of the first anode substrate to the pixel unit, and a second anode substrate arranged opposite to the rear surface of the electron emitter substrate, the second anode substrate adapted to receive electrons emitted from the electron emitter substrate, to emit light in response to the electrons, and to reflect light to the first anode substrate and to the pixel unit.

The electron emitter substrate may include a transparent substrate, and a plurality of emitters on both surfaces of the transparent substrate. The electron emitter substrate may further include transparent operational elements adapted to cause the plurality of emitters to emit electrons. Each of the plurality of emitters may correspond to a light source.

BRIEF DESCRIPTION OF THE DRAWINGS

The above and other features and advantages will become more apparent to those of ordinary skill in the art by describing in detail exemplary embodiments thereof with reference to the attached drawings, in which.

DETAILED DESCRIPTION OF THE INVENTION

Figure 1:
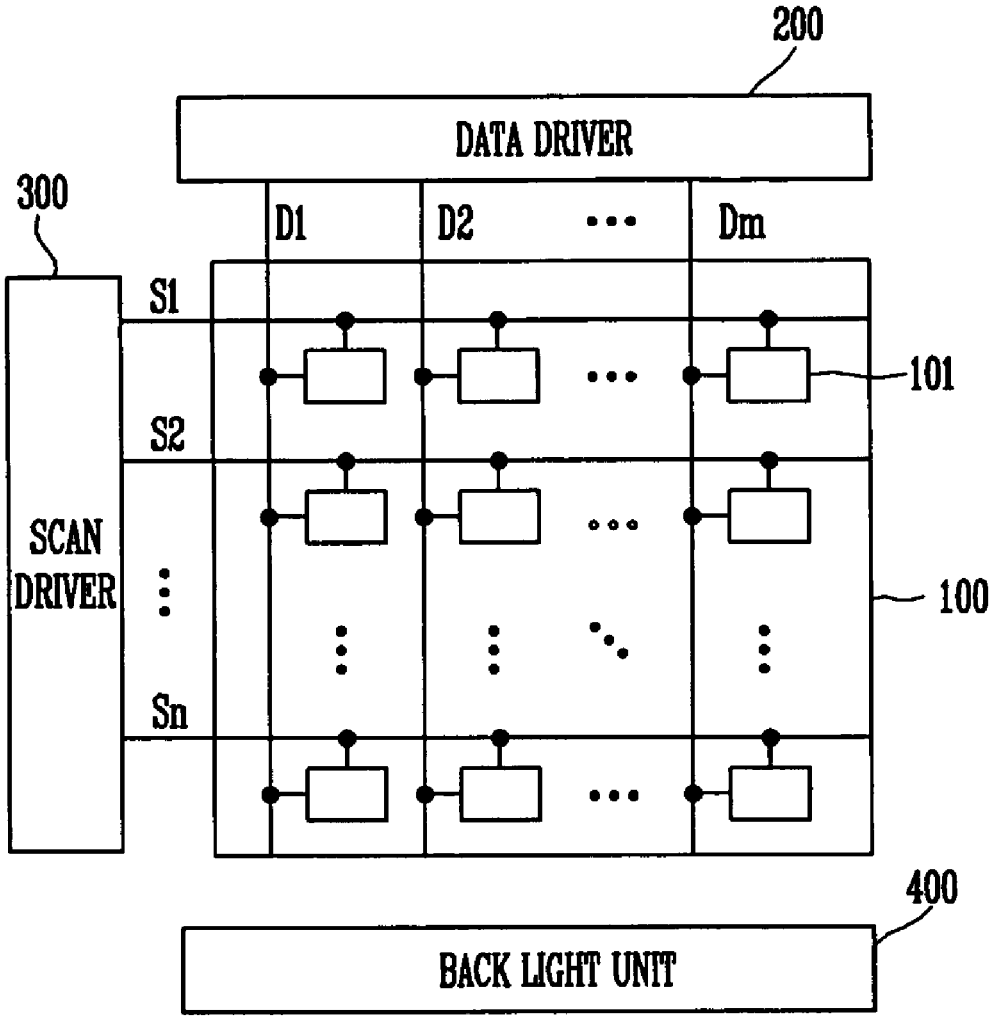
FIG. 1 illustrates a schematic view of a display according to an embodiment.

Korean Patent Application No. 10-2006-0131035, filed on Dec. 20, 2006, in the Korean Intellectual Property Office, in the Korean Intellectual Property Office, and entitled: "Back Light Unit for Electron Emission Device and Liquid Crystal Display Thereof," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present.

Here, when one element is connected to another element, one element may be not only directly connected to another element but also indirectly connected to another element via another element. Further, irrelevant elements may be omitted for clarity. Also, like reference numerals refer to like elements throughout.

FIG. 1 illustrates a schematic view of a display, e.g., an LCD, according to an embodiment. Referring to FIG. 1, the display may include a pixel unit 100, a data driver 200, a scan driver 300, and a back light unit 400.

The pixel unit 100 may include a plurality of data lines (D1, D2, . . . , Dm), a plurality of scan lines (S1, S2, . . . , Sn) and a plurality of pixels 101. The plurality of data lines (D1, D2, . . . , Dm) may cross the plurality of scan lines (S1, S2, . . . , Sn). The plurality of pixels 101 may be formed at an intersection of corresponding ones of the plurality of data lines (D1, D2, . . . , Dm) and the plurality of scan lines (S1, S2, . . . , Sn). One pixel of the plurality of pixels 101 may correspond to one liquid crystal (LC) cell (not shown). Each LC cell may receive a data signal and a scan signal via a corresponding data line of the plurality of data lines (D1, D2, . . . , Dm) and scan line of the plurality of scan lines (S1, S2, . . . , Sn). Each LC cell may transmit or interrupt light incident thereon by controlling an orientation of LCs in the LC cell, to thereby display an image.

The pixel unit 100 may be divided into a plurality of blocks. In order to display an image, blocks displaying a bright image may receive light from a bright light source and blocks displaying a dark image may receive light from a dark light source. As a result, a dark region and a bright region within one image may be controlled with different brightnesses.

The data driver 200 may be connected to and transmit a data signal to the plurality of data lines (D1, D2, . . . , Dm), which, in turn, transmit the data signal to the pixel unit 100. The scan driver 300 may be connected to and transmit a scan signal to the plurality of scan lines (S1, S2, . . . , Sn), which, in turn, transmit the data signal to a pixel 101 selected by the scan signal.

The back light unit 400 may generate light to be transmitted to the pixel unit 100. The pixel unit 100 may transmit or interrupt light received from the back light unit 400 to display an image in each of the LC cells of the pixel unit 100.

The back light unit 400 may include electron emission devices having a plurality of emitters. The plurality of the emitters may serve as a plurality of light sources. Each light source may correspond to one block. The emitters may include carbon nanotubes (CNTs).

The back light unit 400 may control the entire luminance to correspond to a luminance in which the pixel unit 100 emits the light during one frame period. That is, if all pixels 101 of the entire pixel unit 100 are to emit light with a high luminance during one frame period, the entire back light unit 400 may emit light with a low luminance, and, if all pixels 101 of the entire pixel unit 100 are to emit light with a low luminance, the entire back light unit 400 may emit light with a high luminance. Therefore, if the pixel unit 100 emits light with a high luminance, glare may be prevented or reduced and power consumption may be reduced by consistently reducing luminance. Further, if the pixel unit 100 emits light with a low luminance, visibility may be improved by consistently increasing luminance.

Figure 2:
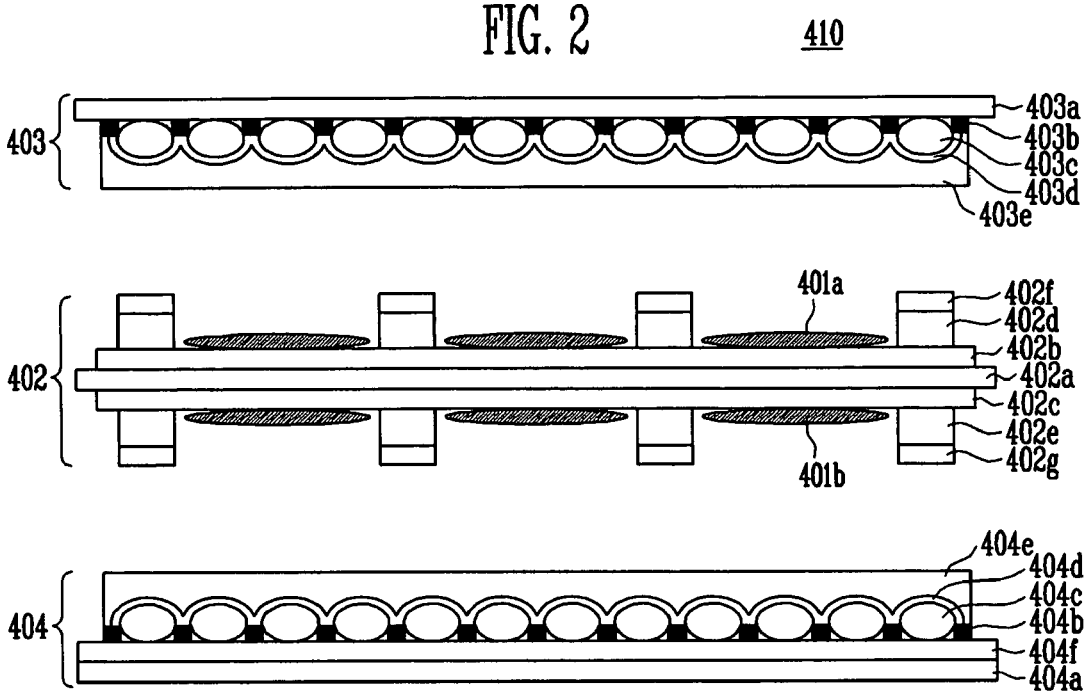
FIG. 2 illustrates a cross-sectional view of a light source unit using an electron emission device according to an embodiment.

FIG. 2 illustrates a cross-sectional view of a light source unit 410 for use in the back light unit 400 according to an embodiment. Referring to FIG. 2, the light source unit 410 may include an electron emitter substrate 402, a first anode substrate 403, and a second anode substrate 404. The electron emitter substrate 402 may be arranged between the first anode substrate 403 and the second anode substrate 404.

The electron emitter substrate 402 may include cathode electrodes 402*b*, 402*c* on a front surface and a rear surface of a transparent substrate 402*a*, respectively. The cathode electrodes 402*b*, 402*c* may be arranged at a constant interval. The electron emitter substrate 402 may also include a plurality of transparent insulator films 402*d*, 402*e* crossing the cathode electrodes 402*b*, 402*c* and arranged at a constant interval. The electron emitter substrate 402 may also include gate electrodes 402*f*, 402*g* on the transparent insulator films 402*d*, 402*e*. The cathode electrodes 402*b*, 402*c* and the gate electrodes 402*f*, 402*g* may be transparent, e.g., indium tin oxide (ITO), indium zinc oxide (IZO), etc. Emitters 401*a*, 401*b* may be formed on the cathode electrodes 402*b*, 402*c* arranged between adjacent gate electrodes 402*f*, 402*g*. The emitters 401*a*, 401*b* may include CNTs. The emitters 401*a*, 401*b* emit electrons in response to a voltage difference between the cathode electrodes 402*b*, 402*c* and the gate electrodes 402*f*, 402*g*.

The first anode substrate 403 may include a black matrix 403*b* on a rear surface of a transparent substrate 403*a*, i.e., a surface facing the electron emitter substrate 402. The black matrix 403*b* may have a regular pattern. A photoluminescent material 403*c*, e.g., a fluorescent material, a phosphorescent material, etc., may be provided between adjacent portions of the black matrix 403*b*. The photoluminescent material 403*c* emits light in response to electrons emitted by the electron emitter substrate 402. An interlayer 403*d* may be formed on the black matrix 403*b* and the photoluminescent material 403*c*. An anode electrode 403*e* may be formed on the interlayer 403*d*, and a high voltage may be applied to the anode electrode 403*e*. The anode electrode 403*e* may be transparent, e.g., ITO, IZO, etc.

The second anode substrate 404 may include a reflective layer 404*f* on a front surface of a substrate 404*a*, i.e., a surface facing the electron emitter substrate 402. The substrate 404*a* may or may not be transparent. A black matrix 404*b* may be formed on the reflective layer 404*f*. The black matrix 404*b* may have a regular pattern. A photoluminescent material 404*c* may be formed between adjacent portions of the black matrix 404*b*, and emits light in response to electrons output by the electron emitter substrate 402. An interlayer 404*d* may be formed on the black matrix 404*b* and the photoluminescent material 404*c*. An anode electrode 404*e* may be formed on the interlayer 404*d*, and a high voltage may be applied to the anode electrode 404*e*. The reflective layer 404*f* may be any highly reflective material, e.g., aluminum, etc., and the anode electrode 404*e* may be transparent, e.g., ITO, IZO, etc.

If the light source unit 410 of the back light unit 400 is configured as discussed above, both emitters 401*a*, 401*b*, formed respectively in the front surface and the rear surface of the transparent substrate 402*a* of the electron emitter substrate 402 may emit electrons to excite a photoluminescent material opposite the emitters 401*a*, 401*b*. In particular, emitters 401*a* on the front surface of the transparent substrate 402*a* emit electrons toward the first anode substrate 403, and emitters 401*b* on the rear surface of the transparent substrate 402*a* emit electrons toward the second anode substrate 404. Photoluminescent material 403*c*, 404*c* emit light in response to these electrons. Light emitted from the first anode substrate 403 is irradiated toward the front surface of the first anode substrate 403. Light emitted from the second anode substrate 404 is reflected by the reflective layer 404*b* and is also irradiated toward the front surface of the first anode substrate 403. In particular, since the electron emitter substrate 402, other than emitters 401*a*, 401*b*, may be transparent, light reflected by the reflective layer 404*b* may be transmitted through transparent regions of the electron emitter substrate 402 and irradiated toward the front surface of the first anode substrate 403.

Accordingly, the back light unit 400 having the light source unit 410 may emit light with a high luminance compared with a conventional back light unit, since higher intensity light may be emitted using a conventional driving voltage. Also, power consumption may be reduced, since luminance may be sufficiently maintained even using a driving voltage lower than the conventional driving voltage.

Figure 3:
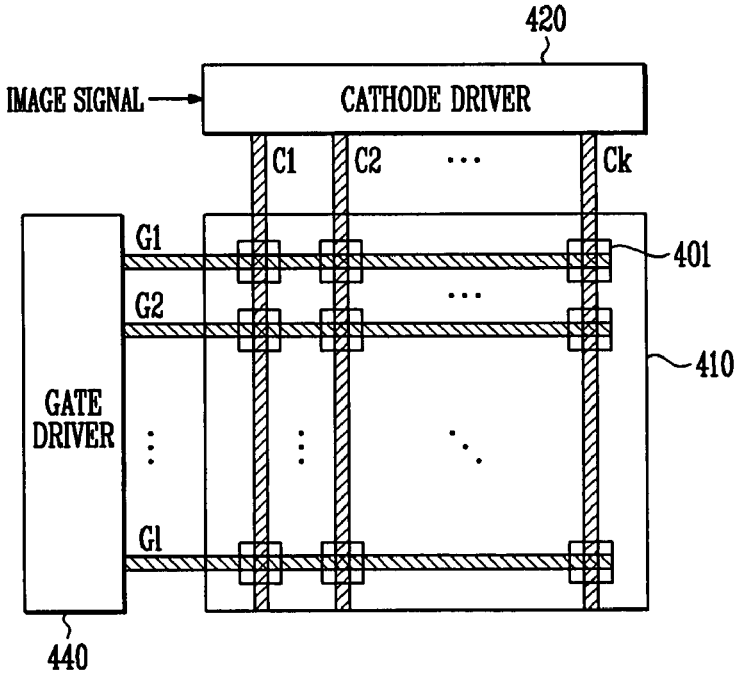
FIG. 3 illustrates a schematic view of a back light unit according to an embodiment.

FIG. 3 illustrates a schematic view of the back light unit 400 as shown in FIG. 1 according to an embodiment. Referring to FIG. 3, the back light unit 400 may include the light source unit 410, a cathode driver 420, and a gate driver 440. Here, for simplicity of explanation, both emitters 401*a*, 401*b* may be referred to collectively as an emitter 401, cathode electrodes 402*b*, 402*c* may be referred to collectively as cathode electrodes (C1, C2, . . . , Cn), and gate electrodes 402*f*, 402*g* may be referred to collectively as gate electrodes (G1, G2, . . . , Gn). Further, the first and second anode substrates are not shown for clarity.

The light source unit 410 may include a plurality of emitters 401 formed in intersecting points between cathode electrodes (C1, C2, . . . , Cn) and gate electrodes (G1, G2, . . . , Gn). Here, electrons emitted from the plurality of emitters 401 collide with the anode substrates (not shown) to cause the photoluminescent material thereon to emit light. The intensity of the emitted light may be determined according to the intensity of the electrons emitted, which corresponds to a voltage difference between the cathode electrodes (C1, C2, . . . , Cn) and the gate electrodes (G1, G2, . . . , Gn). A voltage of the cathode electrodes (C1, C2, . . . , Cn) may be controlled in accordance with an image signal. Pulse width modulation and pulse amplitude modulation methods may be used for this control.

The cathode driver 420 may receive an image signal, generate a block data and a frame data, and generate a cathode signal using the block data and the frame data. The cathode driver 420 may be connected to the cathode electrodes (C1, C2, . . . , Cn) and may transmit the cathode signal to each emitter 401 of the light source unit 410. The block data may correspond to the image signal transmitted to each of the blocks of the pixel unit, and the frame data may represent the sum of the image signal input during one frame period.

The gate driver 430 may be connected to the gate electrodes (G1, G2, . . . , Gn), may generate a gate signal, and may transmit the gate signal to the light source unit 410. The gate driver 430 may be driven in a manner for displaying the entire screen by sequentially allowing the light source unit 410 to emit light for a certain period in a line scan method by horizontal line unit. Such a scan method may reduce circuit cost and power consumption.

Thus, the back light unit and a display according to embodiments may enhance luminous efficiency and display an image with a high luminance, since electrons are emitted from both sides of the electron emitter substrate, which are incident on photoluminescent material opposite these sides. Thus, the back light unit and display according to embodiment may increase luminance and/or decrease an amount of power used to generate a desired luminance.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A back light unit, comprising:

an electron emitter substrate emitting electrons from a front surface and a rear surface thereof;

a first anode substrate arranged opposite to the front surface of the electron emitter substrate, the first anode substrate receiving electrons emitted from the electron emitter substrate, emitting light in response to the electrons, and outputting the light from a front surface of the first anode substrate; and a second anode substrate arranged opposite to the rear surface of the electron emitter substrate, the second anode substrate receiving electrons emitted from the electron emitter substrate, emitting light in response to the electrons, and reflecting the light to the first anode substrate, and the second anode substrate including a photoluminescent material arranged between a reflective layer and a transparent anode electrode, the transparent anode electrode being arranged between the rear surface of the electrode emitter substrate and the photoluminescent material.

2. The back light unit as claimed in claim 1, wherein the electron emitter substrate comprises:

a transparent substrate;

a plurality of first cathode electrodes on a front surface of the transparent substrate;

a plurality of second cathode electrodes on a rear surface of the transparent substrate;

a plurality of first insulators crossing the plurality of first cathode electrodes;

a plurality of second insulators crossing the plurality of second cathode electrodes;

a plurality of first gate electrodes on the plurality of first insulators;

a plurality of second gate electrodes on the plurality of second insulators, substantially an entire length of each second gate electrode overlapping the photoluminescent material of the second anode substrate;

a plurality of first emitters on the plurality of first cathode electrodes and between adjacent first gate electrodes; and a plurality of second emitters on the plurality of second cathode electrodes and between adjacent second gate electrodes.

3. The back light unit as claimed in claim 2, wherein at least one of the plurality of first cathode electrodes, first insulators, first gate electrodes, second cathode electrodes, second insulators, and second gate electrodes is transparent.

4. The back light unit as claimed in claim 3, wherein all of the plurality of first cathode electrodes, first insulators, first gate electrodes, second cathode electrodes, second insulators, and second gate electrodes are transparent.

5. The back light unit as claimed in claim 2, wherein corresponding first and second cathode electrodes receive a same cathode signal, and corresponding first and second gate electrodes receive a same gate signal.

6. The back light unit as claimed in claim 1, wherein the electron emitter substrate comprises:

a transparent substrate; and a plurality of emitters on both surfaces of the transparent substrate.

7. The back light unit as claimed in claim 6, wherein the electron emitter substrate further includes transparent operational elements that cause the plurality of emitters to emit electrons.

8. The back light unit as claimed in claim 1, wherein the first anode substrate comprises:

a first transparent substrate;

a first photoluminescent material on a rear surface of the transparent substrate; and a first transparent anode electrode on the first photoluminescent material, the first photoluminescent material being arranged between the first transparent substrate and the first anode electrode.

9. The back light unit as claimed in claim 8, wherein the first anode substrate further comprises:

a first black matrix on the rear surface of the first transparent substrate, the first photoluminescent material being between adjacent portions of the black matrix;

a first interlayer on the first black matrix and the first photoluminescent material; and the first transparent anode electrode on the first block matrix, the first photoluminescent material, and the first interlayer.

10. The back light unit as claimed in claim 1, wherein the second anode substrate further includes:

a transparent substrate;

the reflective layer on a front surface of the transparent substrate;

the photoluminescent material on the reflective layer; and the transparent anode electrode on the photoluminescent material.

11. The back light unit as claimed in claim 10, wherein the second anode substrate further includes:

a black matrix on the reflective layer, the photoluminescent material being between adjacent portions of the black matrix;

an interlayer on the black matrix and the photoluminescent material; and the transparent anode electrode on the block matrix, the photoluminescent material, and the interlayer.

12. The back light unit as claimed in claim 1, wherein the first anode substrate includes a first photoluminescent material, and the first photoluminescent material and the photoluminescent material of the second anode substrate are the same material.

13. A display, comprising:

a pixel unit receiving a data signal, a scan signal, and light by a block unit, and to display an image, the block unit including a plurality of blocks;

a data driver receiving an image signal, generating the data signal, and transmitting the data signal to the pixel unit;

a scan driver generating the scan signal and transmitting the scan signal to the pixel unit; and a back light unit including a plurality of light sources corresponding to the plurality of the blocks, the back light unit transmitting light to the pixel unit, wherein the back light unit includes:

an electron emitter substrate emitting electrons from a front surface and a rear surface thereof, a first anode substrate arranged opposite to the front surface of the electron emitter substrate, the first anode substrate receiving electrons emitted from the electron emitter substrate, emitting light in response to the electrons, and outputting the light from a front surface of the first anode substrate to the pixel unit, and a second anode substrate arranged opposite to the rear surface of the electron emitter substrate, the second anode substrate receiving electrons emitted from the electron emitter substrate, emitting light in response to the electrons, and reflecting the light to the first anode substrate and to the pixel unit, and the second anode substrate including a photoluminescent material arranged between a reflective layer and a transparent anode electrode, the transparent anode electrode being arranged between the rear surface of the electrode emitter substrate and the photoluminescent material.

14. The display as claimed in claim 13, wherein the electron emitter substrate comprises:

a transparent substrate;

a plurality of first cathode electrodes on a front surface of the transparent substrate;

a plurality of second cathode electrodes on a rear surface of the transparent substrate;

a plurality of first insulators crossing the plurality of first cathode electrodes;

a plurality of second insulators crossing the plurality of second cathode electrodes;

a plurality of first gate electrodes on the plurality of first insulators;

a plurality of second gate electrodes on the plurality of second insulators, substantially an entire length of each second gate electrode overlapping the photoluminescent material of the second anode substrate;

a plurality of first emitters on the plurality of first cathode electrodes and between adjacent first gate electrodes; and a plurality of second emitters on the plurality of second cathode electrodes and between adjacent second gate electrodes.

15. The display as claimed in claim 14, wherein at least one of the plurality of first cathode electrodes, first insulators, first gate electrodes, second cathode electrodes, second insulators, and second gate electrodes is transparent.

16. The display as claimed in claim 15, wherein all of the plurality of first cathode electrodes, first insulators, first gate electrodes, second cathode electrodes, second insulators, and second gate electrodes are transparent.

17. The display as claimed in claim 13, wherein the electron emitter substrate comprises:

a transparent substrate; and a plurality of emitters on both surfaces of the transparent substrate.

18. The back light unit as claimed in claim 17, wherein the electron emitter substrate further includes transparent operational elements adapted to cause the plurality of emitters to emit electrons.

19. The display as claimed in claim 17, wherein each of the plurality of emitters corresponds to a light source.

20. The display as claimed in claim 13, wherein the first anode substrate includes a first photoluminescent material, and the first photoluminescent material and the photoluminescent material of the second anode substrate are the same material.

* * * * *